US007075223B2

(12) United States Patent
Ando

(10) Patent No.: US 7,075,223 B2
(45) Date of Patent: Jul. 11, 2006

(54) ELECTRON BEAM APPARATUS WITH POTENTIAL SPECIFYING PLATE STRUCTURE

(75) Inventor: Yoichi Ando, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 140 days.

(21) Appl. No.: 10/684,374

(22) Filed: Oct. 15, 2003

(65) Prior Publication Data

US 2004/0080259 A1 Apr. 29, 2004

(30) Foreign Application Priority Data

Oct. 23, 2002 (JP) ..... 2002-308492

(51) Int. Cl.
*H01J 1/62* (2006.01)
*H01J 63/04* (2006.01)

(52) U.S. Cl. ..... 313/495; 313/309; 313/336; 313/351

(58) Field of Classification Search ..... 313/495, 313/496, 497, 309, 310, 336, 346 R, 351
See application file for complete search history.

(56) References Cited

U.S. PATENT DOCUMENTS

| | | | | |
|---|---|---|---|---|
| 5,905,335 | A | 5/1999 | Fushimi et al. | 313/495 |
| 5,936,343 | A * | 8/1999 | Fushimi et al. | 313/495 |
| 5,955,850 | A * | 9/1999 | Yamaguchi et al. | 313/495 |
| 6,053,791 | A | 4/2000 | Fujii et al. | 445/6 |
| 6,184,619 | B1 | 2/2001 | Yamazaki et al. | 313/495 |
| 6,441,544 | B1 | 8/2002 | Ando et al. | 313/310 |
| 6,534,911 | B1 | 3/2003 | Ando | 313/496 |
| 6,828,722 | B1 * | 12/2004 | Ueda et al. | 313/495 |
| 2002/0005692 | A1 | 1/2002 | Ando | 313/495 |
| 2003/0164675 | A1 | 9/2003 | Ando | 313/495 |

FOREIGN PATENT DOCUMENTS

| | | |
|---|---|---|
| EP | 0 725 420 A2 | 8/1996 |
| EP | 0 869 530 A2 | 10/1998 |
| JP | 8-315723 | 11/1996 |
| JP | 10-334834 | 12/1998 |
| KR | 2002-0018266 | 3/2002 |
| KR | 2002-0066581 | 8/2002 |

* cited by examiner

*Primary Examiner*—Joseph Williams
*Assistant Examiner*—Kevin Quarterman
(74) *Attorney, Agent, or Firm*—Fitzpatrick, Cella, Harper & Scinto

(57) ABSTRACT

In an electron beam apparatus including an electron source and an electron beam irradiation member, a potential specifying plate including openings through which an electron transmits is provided between the electron source and the electron beam irradiation member. A spacer is located between the electron beam irradiation member and the potential specifying plate. In the case where a distance between a region between one opening of the potential specifying plate near the spacer and the spacer and the electron beam irradiation member is D1 and a distance between a region between that opening and another opening not near the spacer and the electron beam irradiation member is given by D2, if D1<D2 is satisfied, a deviation of an orbit of an electron beam emitted from the electron source is suppressed, so that it is possible to produce a high quality image.

6 Claims, 11 Drawing Sheets

ELECTRON BEAM APPARATUS WITH POTENTIAL SPECIFYING PLATE STRUCTURE

BACKGROUND OF THE INVENTION

1. Field of the Invention

The present invention relates to an electron beam apparatus which is represented by an image forming apparatus such as an image display device.

2. Related Background Art

Up to now, there have been known two types of electron-emitting devices, i.e., a thermal electron source and a cold cathode electron source. The cold cathode electron source includes a field emission type device (hereinafter referred to as FE-type device), a metal/insulating layer/metal type device (hereinafter referred to as MIM device), a surface conduction type electron-emitting device (hereinafter referred to as SCE device).

The inventors have studied a flat type image display device as an application of the electron source in which a large number of electron-emitting devices described above are arranged. In such a thin image display device using an envelope, there is the case where spacers are used as atmospheric-pressure-resistant support structures. A thickness of the envelope can be reduced by the spacers. In particular, in the case of a large size device, the spacers are effective in reducing a weight of the device and a raw material cost. In order to electrically separate a drive potential of the electron-emitting device from a high potential of an accelerating electrode, insulating members are used for the spacers.

The flat type image display devices using the spacers are disclosed in, for example, EP 869530 (Japanese Patent Application Laid-Open No. H10-334834) (Patent Document 1) and EP 725420 (Japanese Patent Application Laid-Open No. H08-315723) (Patent Document 2).

However, according to the image display device having the spacers, in which the electron-emitting devices are arranged, the following problem is caused. That is, the spacers composed of insulating members are charged and electron orbits near the spacers are affected by the charged spacers, so that a displacement of a light emission position is caused. This causes an image deterioration such as a reduction in light emission intensity or a color blur in pixels near the spacers in the case of, for example, the image display device.

A possible cause of the charge of the spacers is an electron reflected on a face plate which is a portion to be irradiated with an electron beam. With respect to the insulating spacers, it is estimated from electron orbit calculation and experimental results that the surfaces of the spacers are positively charged by secondary electron emission. Because the kinetic energy of the electron is small in the vicinity of the electron source, the orbit thereof is greatly distorted by an electric field. In the case where the electron is intended to be reached in a desirable position of a phosphor, it is necessary to prevent the charge of the spacers, in particular, near the electron source.

In order to reduce the charge of the spacers, an idea in which a high resistance film is provided on the surface of each of the spacers is described in, for example, the above-mentioned Patent Document 1.

However, even if a pitch among the electron-emitting devices is reduced to increase the resolution of the display device, sufficient effect can not be attained. In addition, there is even a case where a slight beam displacement, which was not a problem in a conventional display device, causes degradation in quality of a display image.

SUMMARY OF THE INVENTION

The present invention has been made to solve the problems of the conventional techniques. An object of the present invention is to provide an electron beam apparatus such as an image forming apparatus in which an orbit deviation of an electron beam emitted from an electron-emitting device is suppressed, so that a high brightness and high quality image can be produced.

In order to solve the above-mentioned problems concerning the spacer, according to a first aspect of the present invention, there is provided an electron beam apparatus, including:

an electron source including an electron-emitting device;

an electron beam irradiation member which is opposed to the electron source and irradiated with an electron emitted from the electron-emitting device;

a potential specifying plate which is located between the electron source and the electron beam irradiation member and which includes a plurality of openings through which the electron emitted from the electron-emitting device transmits; and a spacer located between the electron beam irradiation member and the potential specifying plate, in which in the case where a distance between a region between one opening of the plurality of openings of the potential specifying plate which is near the spacer and the spacer and the electron beam irradiation member is given by D1 and a distance between a region between the one opening of the potential specifying plate which is near the spacer and another opening of the plurality of openings of the potential specifying plate which is not near the spacer and the electron beam irradiation member is given by D2, a relationship D1<D2 is satisfied.

Further, according to a second aspect of the present invention, there is provided an electron beam apparatus, including:

an electron source including an electron-emitting device;

an electron beam irradiation member which is opposed to the electron source and irradiated with an electron emitted from the electron-emitting device;

a potential specifying plate which is located between the electron source and the electron beam irradiation member and which includes a plurality of openings through which the electron emitted from the electron-emitting device transmits; and a spacer located between the electron source and the potential specifying plate, in which in the case where a distance between a region between one opening of the plurality of openings of the potential specifying plate which is near the spacer and the spacer and the electron-emitting device is given by D3 and a distance between a region between the one opening of the potential specifying plate which is near the spacer and another opening of the plurality of openings which is not near the spacer and the electron-emitting device is given by D4, a relationship D3>D4 is satisfied.

Further, according to the first aspect of the present invention described above, a preferable embodiment thereof is such that a thickness of the region between the one opening of the potential specifying plate which is near the spacer and the spacer is larger than a thickness of another region. And, the potential specifying plate has, between the opening near the spacer and the spacer, a protrusion protruding toward a side of the electron beam irradiation member.

Further, according to the second aspect of the present invention described above, a preferable embodiment thereof is such that a thickness of the region between the one opening of the potential specifying plate which is near the spacer and the other opening of the potential specifying plate which is not near the spacer is larger than a thickness of another region. And, the potential specifying plate has, between the opening near the spacer and the another opening not near the spacer, a protrusion protruding toward a side of the electron beam irradiation member.

DETAILED DESCRIPTION OF THE PREFERRED EMBODIMENTS

Figure 1:
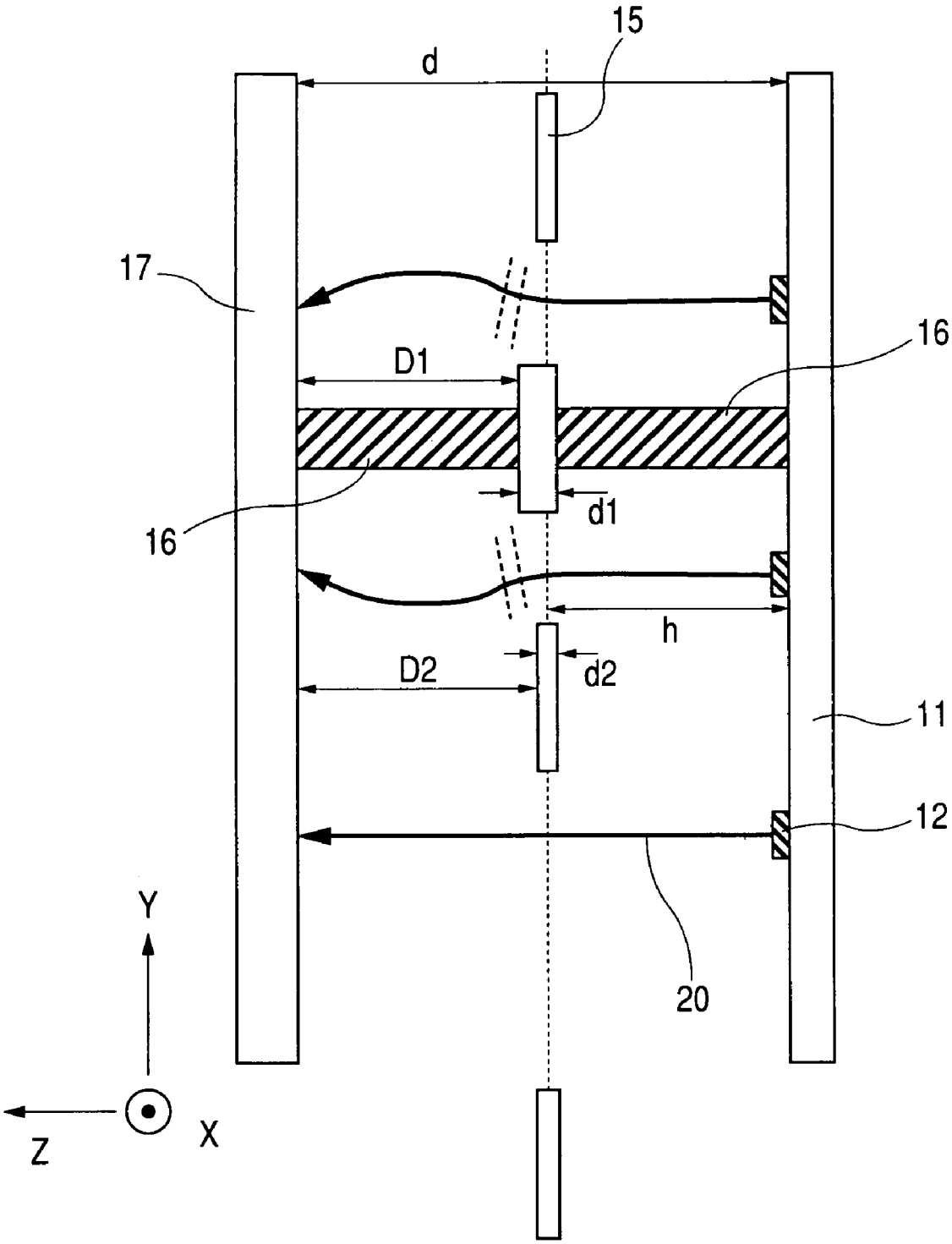
FIG. 1 is a sectional view showing Embodiment 1 of an electron beam apparatus according to the present invention.

According to the present invention, an opening structure of a potential specifying plate is determined according to a positional relationship with spacers and further, a potential of the potential specifying plate is suitably specified. Accordingly, an electron beam apparatus such as an image forming apparatus capable of suppressing a deviation of an electron beam resulting from the spacers to produce a high brightness and high quality image can be provided.

For an electron beam apparatus of the present invention, a structure of an image forming apparatus can be typically used. The following structures may be used for the electron beam apparatus.

(1) An image forming apparatus forms an image by irradiating an image forming member with an electron emitted from an electron-emitting device in response to an input signal. In particular, an image display device in which the image forming member is a phosphor can be constructed.

(2) With respect to the electron-emitting device, a simple matrix arrangement including a plurality of cold cathode devices which are wired in matrix by a plurality of row directional wirings and a plurality of column directional wirings can be used.

(3) Also, according to the idea of the present invention, the electron-emitting device is not limited for the image display device and therefore can be used as an alternative light emitting source such as a light emitting diode of an optical printer which is composed of a photosensitive drum, a light emitting diode, and the like. In addition, in the case where m-row directional wirings and n-column directional wirings as described above are selected as appropriate, the electron-emitting device can be applied for not only a linear light emitting source but also a two-dimensional light emitting source. In this case, the image forming member is not limited to a material that directly emits light, such as a phosphor which is used in the embodiments described later. Accordingly, a member in which a latent image is formed by charging electrons is used.

Also, according to the idea of the present invention, the present invention can be applied to the case where an electron beam irradiation member irradiated with electrons emitted from the electron source is a member other than the image forming member such as the phosphor, as in the case of, for example, an electron microscope. Thus, according to the present invention, a structure of a general electron beam apparatus in which the electron beam irradiation member is not specified to the image forming member can be used.

Hereinafter, embodiments of the present invention will be described in detail with reference to the drawings.

In respective embodiments as described below, a multi-electron beam source is used. In the multi-electron beam source, the SCE device of a type having an electron-emitting region in a conductive particle film between electrodes is used. N×M (N=3072, M=1024) surface conduction type electron-emitting devices of the above-mentioned type are wired in matrix through M row directional wirings and N column directional wirings (see FIG. 9). Note that the electron-emitting device may be a thermal electron source and a cold cathode electron source. In the case of the cold cathode electron source, a field emission type device (hereinafter referred to as an FE-type device), a metal/insulating layer/metal type device (hereinafter referred to as MIM device), which are described above, a device using a carbon nanotube for an electron-emitting region, and the like can be used in addition to the SCE device.

(Embodiment 1)

Figure 2:
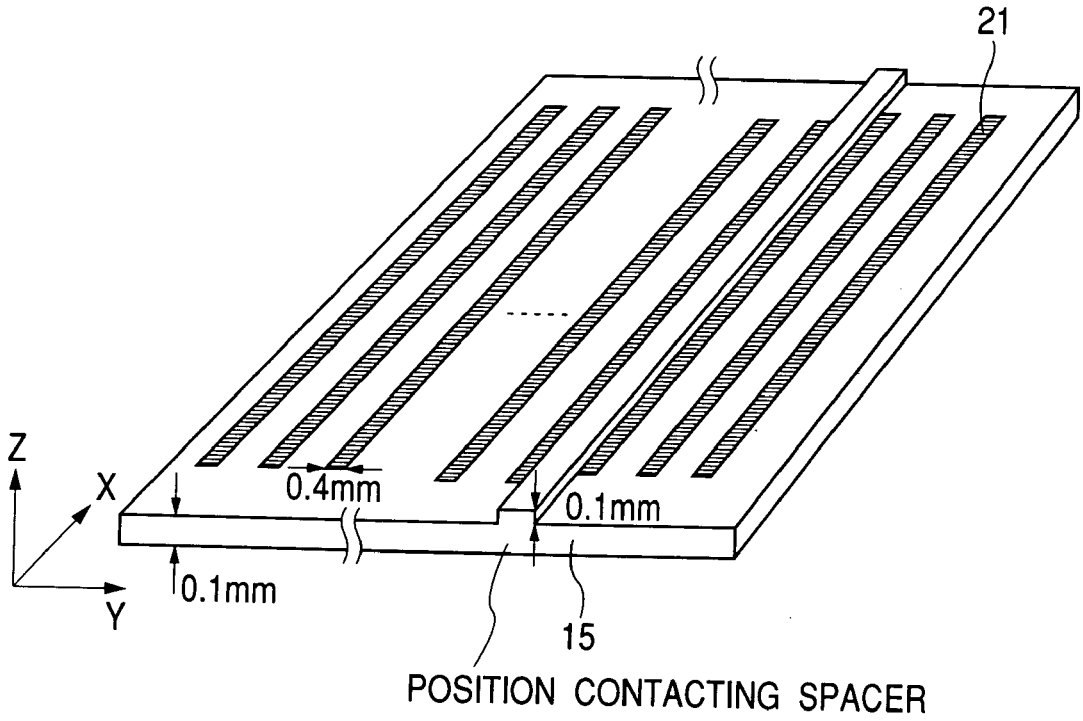
FIG. 2 shows an example of a grid according to Embodiment 1 of the present invention.

FIG. 1 is a sectional view of an image display device according to this embodiment and FIG. 2 shows a potential specifying plate (hereinafter referred to as grid). Referring to FIGS. 1 and 2, the image display device includes a rear plate 11 in which the electron-emitting devices each having an electron-emitting region 12 are arranged in matrix, a grid 15 having electron transmission ports 21, insulating spacers 16 each having a plate shape as described later, a face plate 17 in which a phosphor and a metal back (which are not shown) are provided. Reference numeral 20 denotes an electron beam orbit. Note that, with respect to the grid 15 shown in FIG. 2, for easy understanding, a size thereof in a thickness direction is exaggerated. Each of the spacers 16 is composed of two spacer portion, which are a face plate side spacer portion and a rear plate side spacer portion, and which are constructed so as to sandwich therebetween the grid.

Although not used in this embodiment, there is the case where an antistatic film (high resistance film) is provided on each of the main surfaces of the spacers and an electrode film (low resistance film) is provided on each of contact regions between the spacer and the respective plates. In such a case, each of the spacers can be composed of an insulating base member such as a glass plate or a ceramic plate, a high resistance film for charge protection which is formed on each of the main surfaces of the insulating base member, and a low resistance film (conductive film). The low resistance film is formed on a contact surface between the insulating base member and the inside portion of the face plate (metal back), on a contact surface between the insulating base member and the surface of the rear plate (row directional wiring or column directional wiring), and on side surface regions which are in contact with the contact surfaces. In view of keeping a charge protection effect and suppressing power consumption resulting from a leak current, it is preferable that the high resistance film has a sheet resistance (area resistivity) of $10^5$ [Ω/square] to $10^{12}$ [Ω/square]. In addition, the low resistance film may have a resistance value sufficiently lower than the high resistance film. A material of the low resistance film is appropriately selected from: a metal such as Ni, Cr, Au, Mo, W, Pt, Ti, Al, Cu, or Pd; an alloy of those metals; a printed conductor which is composed of a metal such as Pd, Ag, or Au, a metal oxide such as $RuO_2$, or an alloy such as Pd—Ag, and glass; a transparent conductor such as $In_2O_3$—$SnO_2$; a semiconductor material such as polysilicon; and the like.

An accelerating voltage Va is applied from an external power source (not shown) to the metal back on the face plate 17 and a grid voltage Vg (=Va×d/h) is applied from the external power source to the grid.

Note that the grid voltage Vg (=Va×d/h) is substantially equal to a potential determined by a spatial distance between the face plate and the rear plate.

A region of the grid 15 other than the vicinity of the spacer is provided such that the center of thickness (center position in the thickness direction) of the region of the grid is located at a distance of 0.8 mm (h) from the surface of the rear plate 11 with respect to an interval d (=1.6 mm) between the face plate 17 and the rear plate 11. A thickness of the region of the grid other than the vicinity of the spacer is set to 0.1 mm. A region of the grid in which the spacer is located is thickened so as to protrude to the face plate side by 0.1 mm. Thus, a distance (D1) between a region of the grid (potential specifying plate) (between an opening which is near the spacer and the spacer) and the phosphor or the metal back (electron beam irradiation member) is made shorter than a distance (D2) between a region of the grid (between the opening which is near the spacer and an opening of the grid which is not near the spacer) and the phosphor or the metal back (D1<D2). With respect to thicknesses of regions around the opening of the grid which is near the spacer, a thickness of the region near the spacer (d1) becomes larger than a thickness of the region which is not near the spacer (d2) and the region near the spacer is thickened to the electron beam irradiation member side (d1>d2).

When electrons are emitted from the electron emitting regions and the accelerating voltage Va is applied to the metal back, the electrons are led upward to collide with the phosphor, so that the phosphor emits light. At this time, a part of the electrons that collide with the face plate is reflected and collides with the spacers, with the result that the electrons that collide with the spacers are charged. The grid 15 has an effect in which an incidence of the reflected electrons into a region of the spacer 16, which is nearer to the rear plate than the grid 15 (hereinafter referred to as lower spacer region in some cases) is prevented to suppress charge of the lower spacer region, thereby reducing the deviation of the orbits of electrons from light-emitting devices near the spacer 16.

A large number of reflected electrons are blocked by the grid 15 in a region between the grid 15 and the rear plate 11. However, the reflected electrons are charged in a region between the grid 15 and the face plate 17. In the case where charge in the vicinity of the rear plate 11 which is a region in which the kinetic energy of the electron is small is reduced, the deviation of the electron orbit is greatly reduced. However, the deviation of the electron orbit is slightly caused by the charge of the spacer in the face plate 17 side (upper spacer region). In order to relax the deviation, as shown in FIG. 1, an electric field in the openings of the grid 15 near the spacer 16 is distorted (equipotential line is indicated by broken lines). More specifically, the spacer contact region of the grid 15 is thickened so as to protrude to the face plate side by 0.1 mm.

A state of an electron beam orbit at this time will be described with reference to FIG. 1.

First, electrons emitted from the electron sources are upwardly incident into the openings in a direction substantially perpendicular thereto. Next, in the vicinities of the exit ports of the openings, the electrons are flown so as to be apart from the spacer by an electric field distribution produced according to a difference of thicknesses of the grid 15. After that, up to the face plate, the electron orbit follows a course which approaches the spacer by the influence of charge of the upper spacer region. As a result, the electrons reach desirable positions.

It is desirable that the grid is stably located in vacuum, has a low electrical resistance, has a linear expansion coefficient substantially equal to that of the member composing the envelope, and is relatively stable with respect to electron irradiation. It is desirable that a material of the grid is a metallic material such as copper or Ni, an alloy of those materials, or the like. In addition, a member in which the surface of an insulator is coated with a good conductor can be used. In this embodiment, an Fe—Ni alloy of 50% Ni having a thickness of 0.1 mm is used as the grid material.

Also, as shown in FIG. 2, with respect to a shape and a size of each of the electron transmission ports 21, slits each having a width of 0.4 mm are provided in a direction parallel to the longitudinal direction of the spacer. In addition, a thickness region having a thickness of 0.1 mm is provided at a position contacting each of the spacers in the face plate side so as to become a shape protruding to the face plate side.

These values are suitable for the case of this embodiment and changed as appropriate according to structures of an electron emitting device and an image forming apparatus.

Next, a method of manufacturing an electron beam apparatus including the spacers 16 and the grid 15 which are used in this embodiment will be described.

A plate shape is adopted for each of the spacers 16. Side surfaces (two side surfaces other than the main surfaces) of each of the plate-shaped spacers are brought into contact with the rear plate, the face plate, and the grid. An insulating material such as glass or ceramic is used as a material of the spacer. A spacer having an antistatic function may be obtained by forming a high resistance film on the insulating material. With respect to an outer size of the spacer, a length in the longitudinal direction is slightly longer than a width of an image region which is a region in which the phosphor and the metal back are formed. The upper spacer and the lower spacer that compose the spacer are prepared. With respect to a size of the upper spacer, a height (Z-direction in FIG. 1) is 0.65 mm and a plate thickness (Y-direction in FIG. 1) is 0.2 mm. With respect to a size of the lower spacer, a height is 0.75 mm and a plate thickness is 0.2 mm.

Next, an alloy plate which has a size equal to that of an image display region and is made of 50% Fe and 50% Ni is prepared for the grid 15. Slits each having a width of 0.4 mm are formed by general pattering and etching at the same pitch as a pitch of the electron-emitting devices. Further, an alloy of 50% Fe and 50% Ni having a thickness of 0.1 mm is bonded to the position contacting the spacer on the face plate side, so that the thickness region that protrudes to the face plate side by 0.1 mm is provided. After the formation of the slits, as shown in FIG. 1, the spacers 16 are fixed onto the top and bottom surfaces of the grid 15.

The spacer 16 (lower spacer) is fixed using a block-shaped spacer support member in the outside of the image region. In the case where the spacer support member that supports the spacer is located in the outside of the image region, a distortion of an electric field in the vicinity of the electron source where the kinetic energy of the electron is small and the electron orbit is easily influenced by the electric field can be reduced.

A structure, a manufacturing method, and characteristics of a surface conduction type electron-emitting device are disclosed in, for example, the above-mentioned EP 869530. In this embodiment, the structure and the manufacturing method can be used. Here, the structure, the manufacturing method, and the characteristics of the surface conduction type electron-emitting device will be summarized.

Figure 10A:
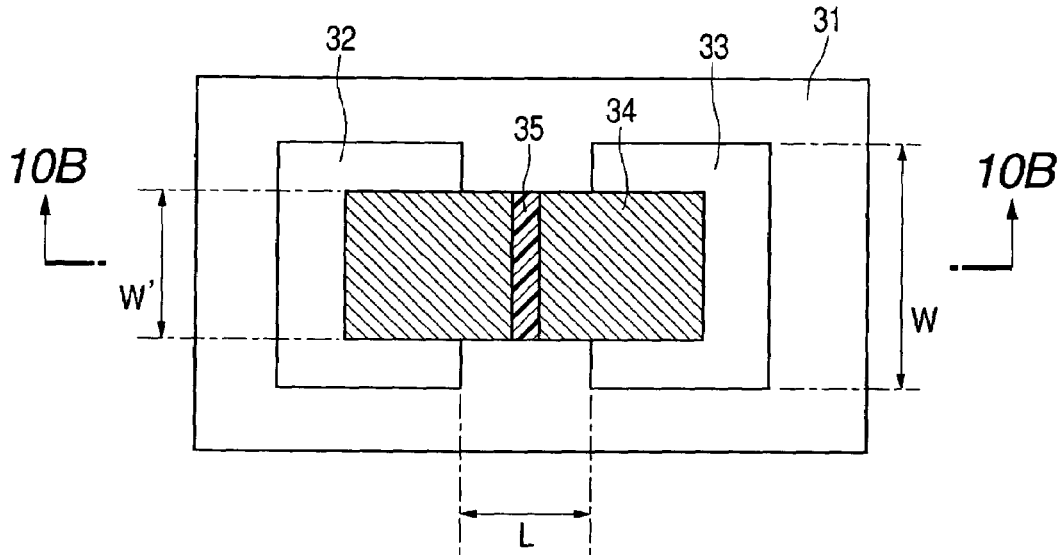
FIGS. 10A and 10B show a typical structure of a surface conduction type electron-emitting device.
Figure 10B:
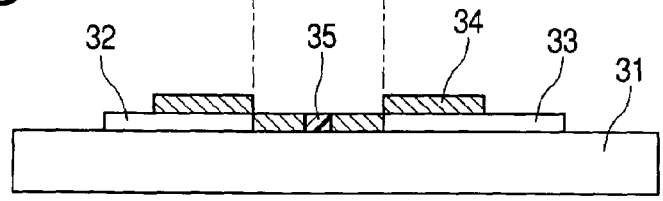

FIGS. 10A and 10B show a typical structure of a surface conduction type electron-emitting device according to the present invention. In FIGS. 10A and 10B, the surface conduction type electron-emitting device includes an insulating substrate 31, device electrodes 32 and 33, an electron-emitting region formation thin film 34, whose ends are connected with the device electrodes 32 and 33, and an electron-emitting region 35 formed in the electron-emitting region formation thin film 34.

In this embodiment, the electron-emitting region 35 in the electron-emitting region formation thin film 34 including the electron-emitting region 35 is made of electrically conductive particles having a particle size of several nm. A region other than the electron-emitting region 35 in the electron-emitting region formation thin film 34 including the electron-emitting region 35 is made of a particle film. Note that the particle film described here is a film in which plural particles are aggregated, and indicates a film (including an island-like film), whose fine structure is not only a state in which the particles are individually dispersed but also a state in which the particles are adjacent to one another or overlapped with one another.

A specific example of a constituent atom or a constituent molecule in the electron-emitting region formation thin film 34 including the electron-emitting region includes a metal such as Pd, Ru, Ag, Au, Ti, In, Cu, Cr, Fe, Zn, Sn, Ta, W, or Pb; an oxide such as PdO, $SnO_2$, $In_2O_3$, PbO, or $Sb_2O_3$; a boride such as $HfB_2$, $ZrB_2$, $LaB_6$, $CeB_6$, $YB_4$, or $GdB_4$; a carbide such as TiC, ZrC, HfC, TaC, SiC, or WC; a nitride such as TiN, ZrN, or HfN; and a semiconductor such as Si or Ge. Further, the specific example includes carbon, AgMg, NiCu, PbSn, and the like.

Also, a method of forming the electron-emitting region formation thin film 34 is a vacuum evaporation method, a sputtering method, a chemical vapor deposition method, a dispersion applying method, a dipping method, a spinner method, or the like.

Figure 11A:
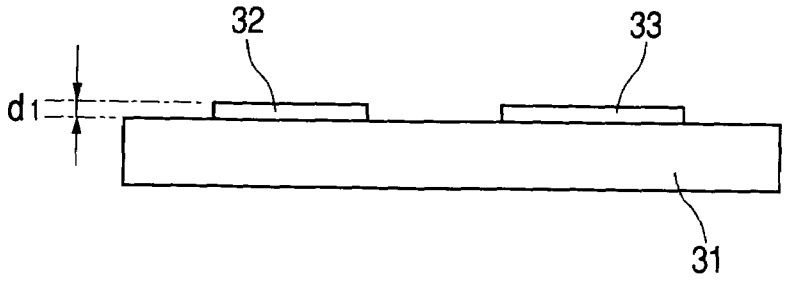
FIGS. 11A, 11B, and 11C show process steps of a method of manufacturing the surface conduction type electron-emitting device.
Figure 11B:
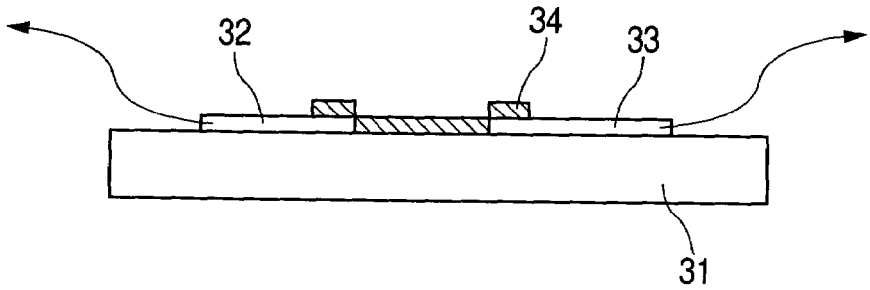
Figure 11C:
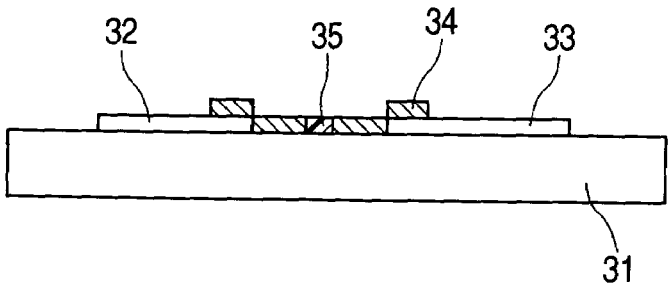

There are various methods of producing the surface conduction type electron-emitting device shown in FIGS. 10A and 10B. FIGS. 11A, 11B, and 11C show an example of the methods.

Hereinafter a method of producing the electron-emitting device will be described. Note that the following description relates to a method of producing a single device. However, such a method is applied to the method of manufacturing the electron source substrate according to the embodiment of the present invention.

(1) The insulating substrate 31 is sufficiently cleaned by a detergent, deionized water, and an organic solvent, and then the device electrodes 32 and 33 are formed on the surface of the insulating substrate 31 by a vacuum evaporation technique or a photolithography technique (FIG. 11A). A material of the device electrodes 32 and 33 may be any of materials having electrical conductivity. There is, for example, nickel metal. With respect to a size of the device electrodes 32 and 33, for example, a device electrode interval L is 10 μm, a device electrode length W is 300 μm, and a film thickness d1 is 100 nm. A thick film printing method may be used as a method of forming the device electrodes 32 and 33. A material used for the printing method is an organic metallic paste (MOD) or the like.

(2) An organic metallic solution is applied between the device electrodes 32 and 33 provided on the insulating substrate 31 and then left to stand to form an organic metallic thin film. Note that the organic metallic solution is a solution of an organic compound containing mainly metal such as Pd, Ru, Ag, Au, Ti, In, Cu, Cr, Fe, Zn, Sn, Ta, W, or Pb. After that, the organic metallic thin film is heated for baking, lifted off, and patterned by etching or the like to form the electron-emitting region formation thin film 34 (FIG. 11B).

(3) Subsequently, a voltage is applied between the device electrodes 32 and 33 by an energization operation called forming, so that the electron-emitting region 35 in which a structural change is produced is formed in a region of the electron-emitting region formation thin film 34 (FIG. 11C). A region, whose structure is changed by locally breaking, deforming, or altering the electron-emitting region formation thin film 34 by the energization operation is called the electron-emitting region 35. As described above, it is observed that the electron-emitting region 35 is composed of metallic particles.

Figure 12A:
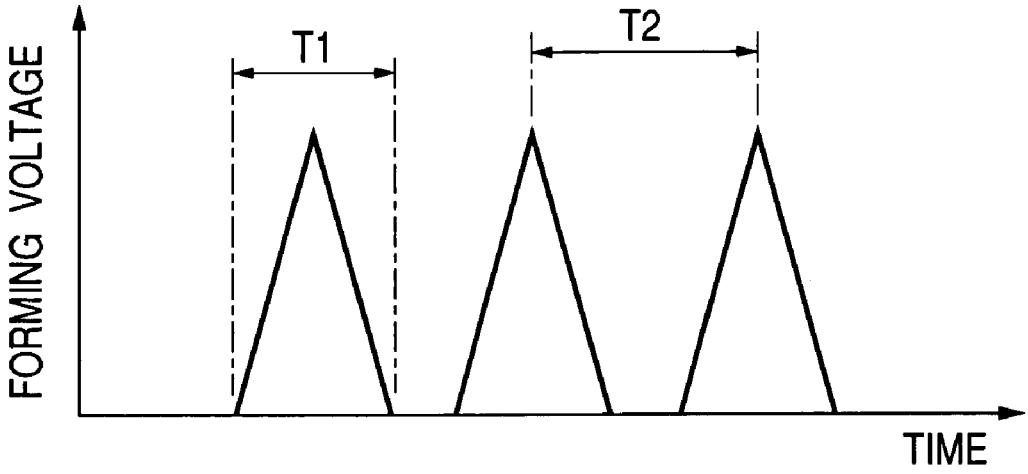
FIGS. 12A and 12B show typical waveforms used for forming operation.
Figure 12B:
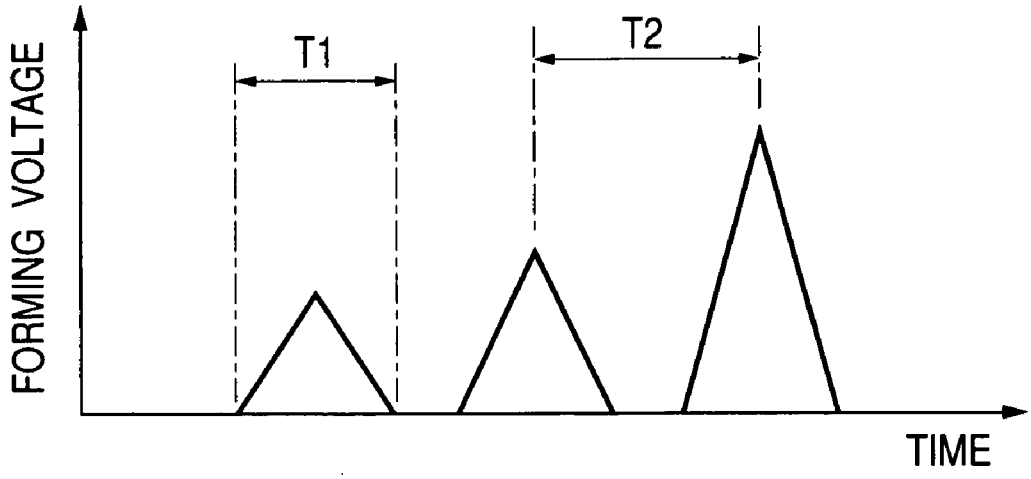

FIGS. 12A and 12B show voltage waveforms during the forming operation. In FIGS. 12A and 12B, T1 and T2 respectively denote a pulse width and a pulse interval of a voltage waveform. T1 is set to 1 microsecond to 10 milliseconds, T2 is set to 10 microseconds to 100 milliseconds, a peak value of a triangular wave (peak voltage at the time of forming) is set to about 4 V to 10 V. The forming operation is performed as appropriate in a vacuum atmosphere for several tens of seconds.

As described above, in the case where the above-mentioned electron-emitting region is formed, the triangular pulse is applied between the device electrodes to perform the forming operation. A waveform of the voltage applied between the device electrodes is not limited to a triangular wave. Therefore, any desirable wave such as a rectangular wave may be used. In addition, a peak value, a pulse width, a pulse interval, and the like of the desirable wave are not limited to the above-mentioned values. If the preferable electron-emitting region is formed, desirable values can be selected.

Figure 9:
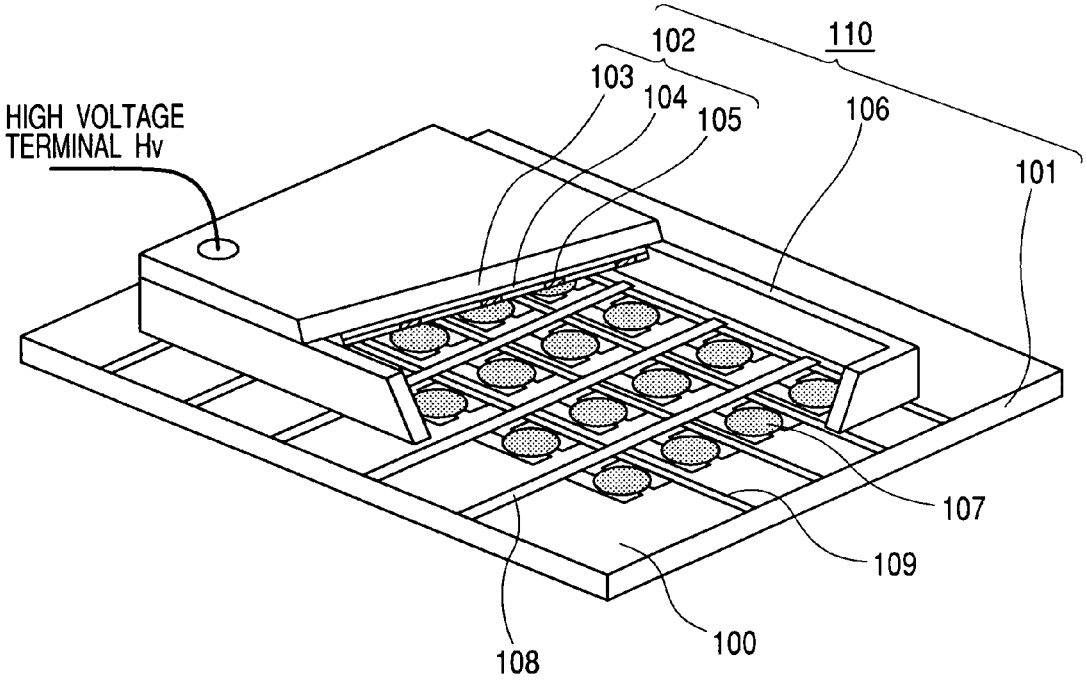
FIG. 9 is a sectional view showing an example of an image forming apparatus used in the present invention.

In this embodiment, with respect to elements other than the grid and the spacers, a display panel produced by the same method as described in EP 869530 (JP 10-334834 A) is used. FIG. 9 is a schematic view of the display panel. Note that, in order to understand the entire structure, the grid and the spacers are omitted. The grid 15 and the spacers 16 are located in the display panel. This production order will be described below.

First, a substrate 100 on which row directional wiring electrodes 108, column directional wiring electrodes 109, an interelectrode insulating layer (not shown), and surface conduction type electron-emitting devices 107 (each including device electrodes and conductive thin film) are formed in advance is fixed onto a rear plate (glass substrate) 101. Next, the spacers formed as described above (rear plate side spacers) are fixed onto the row directional wiring electrodes 108 of the substrate 100 at regular intervals in parallel to the row directional wiring electrodes 108, and then the grid is bonded to the rear plate side spacers. After that, the spacers (face plate side spacers) are bonded to the face plate 102 in which a phosphor 104 and a metal back 105 is provided on the inner surface of glass plate 103. Then, the face plate 102 is located above the substrate 100 by 1.6 mm through a side wall 106, and respective bonding regions among the rear plate 101, the face plate 102, the side wall 106, and the spacers are fixed to one another. A bonding region between the substrate 100 and the rear plate 101, and a bonding region between the rear plate 101 and the side wall 106, are sealed by applying frit glass (not shown) to these bonding regions and baking in an atmosphere at 400° C. to 500° C. for 10 or more minutes. Thus the envelope 110 is formed. Further, an inside of the envelope 110 is evacuated. Thus, the display panel is completed.

In the completed image display device (display panel), a scanning signal and a modulation signal are applied from a signal generating unit (not shown) to each of the cold cathode devices (surface conduction type electron-emitting devices) 107 through an external envelope terminal to emit electrons. A high voltage is applied to the metal back 105 through a high voltage terminal Hv to accelerate the emitted electron beams. Then, the electrons collide with the phosphor 104, so that respective color phosphors composing the phosphor 104 are excited for light emission, thereby displaying an image. Note that an applied voltage Va to the high voltage terminal Hv is set to 10 kV and an applied voltage Vf between the respective wirings 108 and 109 is set to 14 V.

At this time, a light emission spot array including light emission spots resulting from the emitted electrons from the cold cathode devices 107 located in positions near the spacers is two-dimensionally produced at regular intervals. Accordingly, a color image which is sharp and has preferable color reproducibility can be displayed. This exhibits that, even if the spacers are located, such distortion of the electric field that influences the electron orbit is not caused.

(Embodiment 2)

Figure 3:
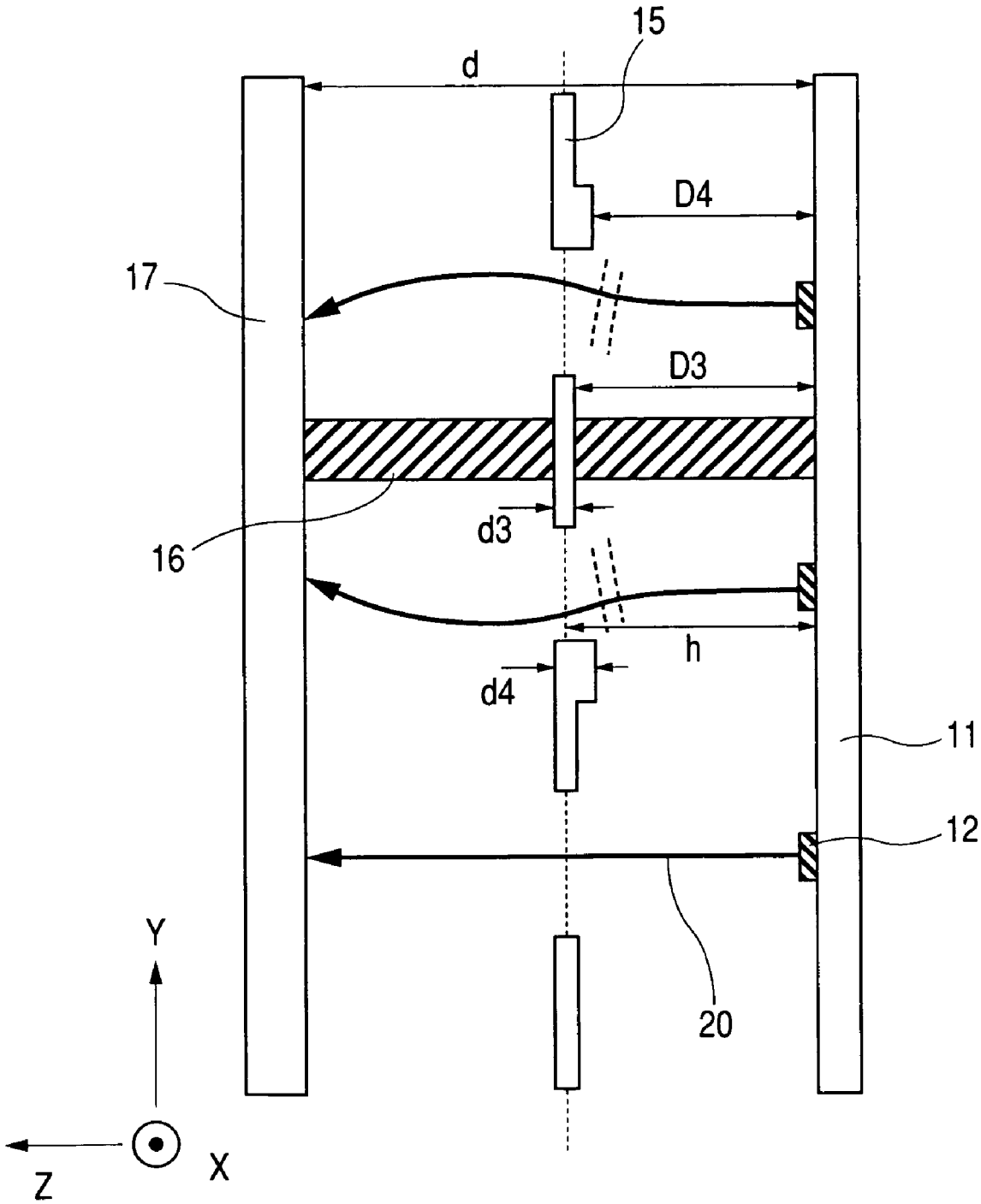
FIG. 3 is a sectional view showing Embodiment 2 of an electron beam apparatus according to the present invention.
Figure 4:
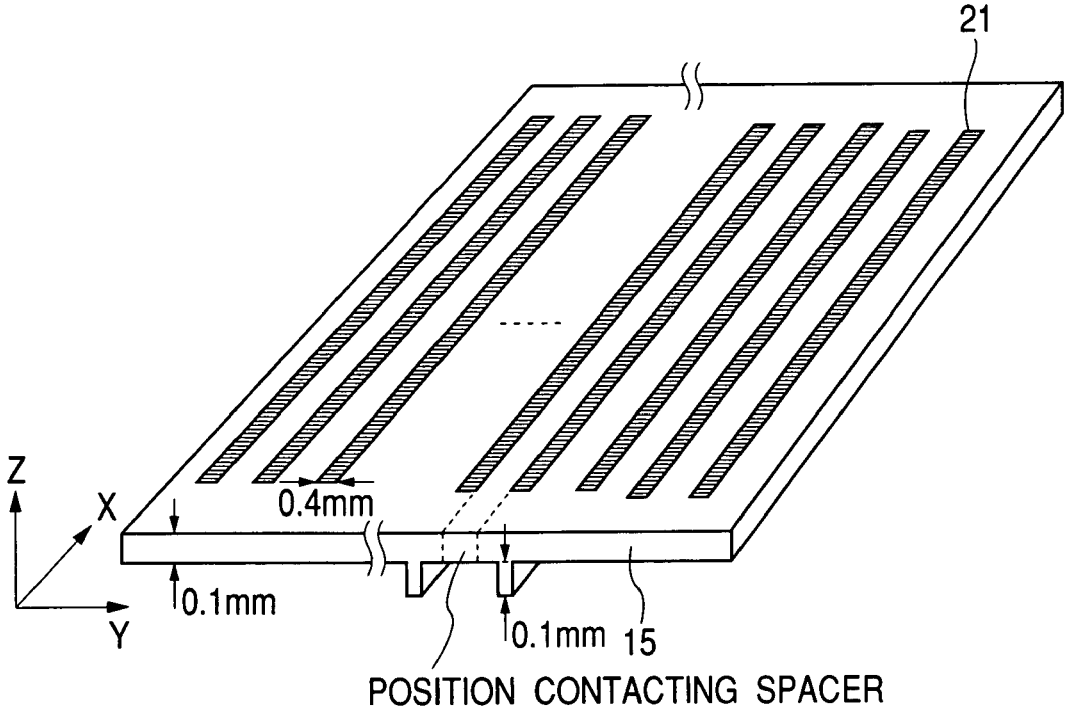
FIG. 4 shows an example of a grid according to Embodiment 2 of the present invention.

FIG. 3 is a sectional view of an image display device according to this embodiment and FIG. 4 shows a grid. A structure of the grid in the thickness direction is different from that in Embodiment 1. Note that a method similar to that in Embodiment 1 can be used as an image display device manufacturing method.

With respect to a specific structure, as shown in FIGS. 3 and 4, a region of the grid 15 which is located in the far side to the spacer in each of the openings nearest to the spacer (region of the grid between the opening which is near the spacer and an opening which is not near the spacer) is thickened so as to protrude to the rear plate side by 0.1 mm. Therefore, a distance (D3) between a region of the grid (between an opening which is near the spacer and the spacer) and the electron-emitting device is made longer than a distance (D4) between a region of the grid (between the opening which is near the spacer and an opening which is not near the spacer) and the electron-emitting device (D3>D4). Thus, an electric field in regions (openings) of the grid 15 near the spacer 16 is distorted (equipotential line is indicated by broken lines). With respect to thicknesses of regions around the opening of the grid which is near the spacer, a thickness of the region which is not near the spacer (d4) becomes larger than a thickness of the region near the spacer (d3) and the region which is not near the spacer is thickened to the electron source (electron-emitting device) side (d4>d3). Note that, with respect to the grid 15 shown in FIG. 4, for easy understanding, a size thereof in the thickness direction is exaggerated. In addition, as in Embodiment 1, the potential of the grid is set to Vg (=Va×h/d).

A state of an electron beam orbit at this time will be described.

First, electrons exited from the electron sources travel to the openings upward in the perpendicular direction.

Next, in the vicinities of the entrance ports of the openings, the electrons are flown so as to be apart from the spacer by an electric field distribution produced according to a difference of thicknesses of the grid 15. After that, up to the face plate, the electrons follow a course which approaches the spacer by the influence of the charged surface of the spacer. As a result, the electrons reach desirable positions.

In this embodiment, as in Embodiment 1, a light emission spot array including light emission spots resulting from the emitted electrons from the cold cathode devices 107 located in positions near the spacers is two-dimensionally produced at regular intervals. Accordingly, a color image which is sharp and has preferable color reproducibility can be displayed.

(Embodiment 3)

Figure 5:
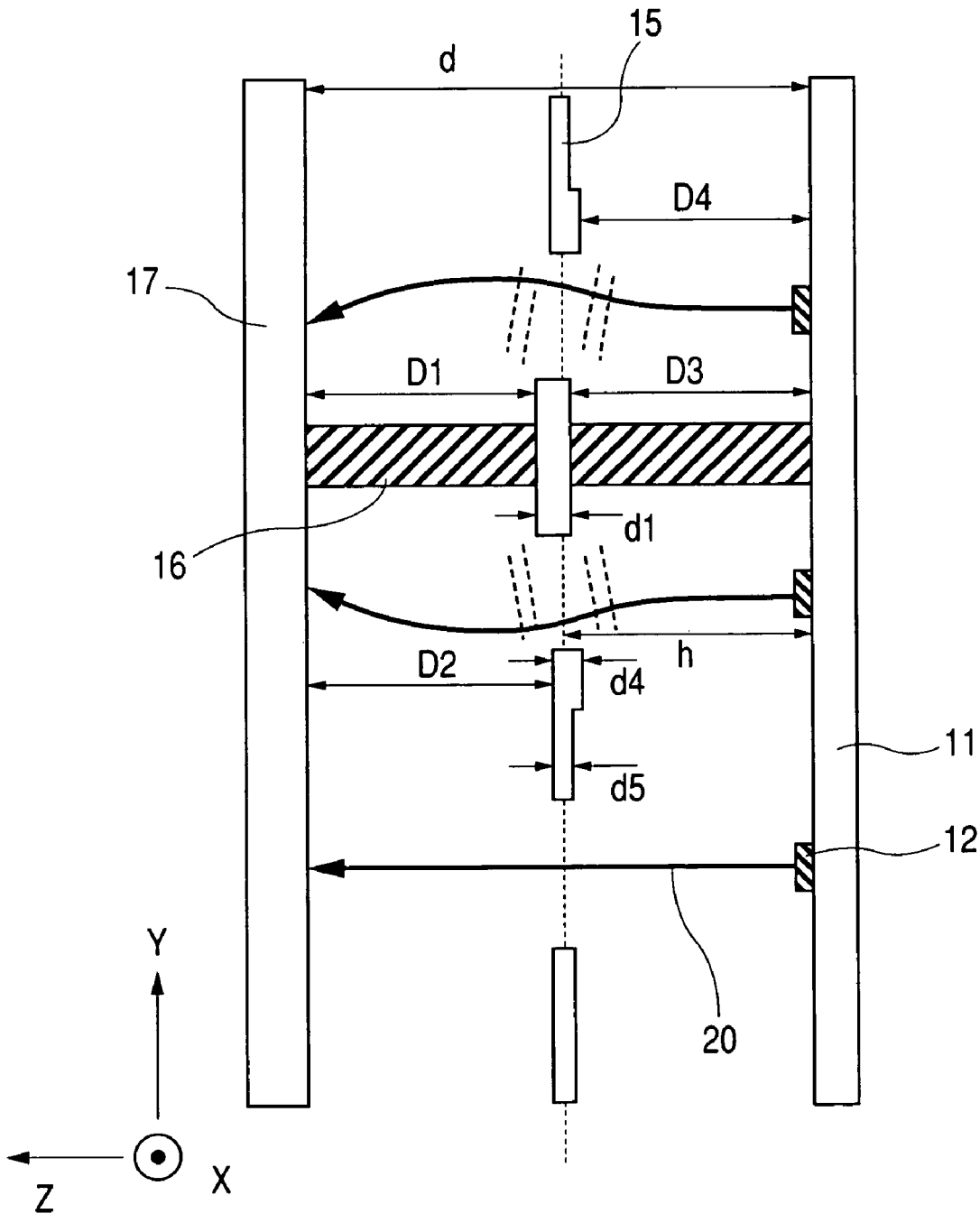
FIG. 5 is a sectional view showing Embodiment 3 of an electron beam apparatus according to the present invention.

FIG. 5 is a sectional view of an image display device according to this embodiment. A grid in this embodiment has a structure corresponding to a combination of Embodiment 1 and Embodiment 2. An image display device can be manufactured by a method similar to those in Embodiment 1 and Embodiment 2.

More specifically, as shown in FIG. 5, the spacer contact region of the grid 15 is thickened so as to protrude to the face plate side by 0.05 mm. In addition, a region of the grid 15 which is located in the far side to the spacer in each of the openings (slits) nearest to the spacer (region of the grid between the opening which is near the spacer and an opening which is not near the spacer) is thickened so as to protrude to the rear plate side by 0.05 mm. Therefore, the distance (D1) between a region of the grid (between the opening which is near the spacer and the spacer) and the phosphor is made shorter than the distance (D2) between a region of the grid (between the opening which is near the spacer and the opening which is not near the spacer) and the phosphor (D1<D2). In addition, the distance (D3) between a region of the grid (between the opening which is near the spacer and the spacer) and the electron-emitting device is made longer than the distance (D4) between the region of the grid (between the opening which is near the spacer and the opening which is not near the spacer) and the electron-emitting device (D3>D4). A thickness of a region of the grid near the spacer, which is located around the opening near the spacer (d1) becomes-larger than a thickness of a region of the grid around the opening which is not near the spacer (d5) in the electron beam irradiation member (phosphor) side (d1>d5). In addition, the region which is not near the spacer (d4 in thickness) is thickened to the electron source (electron-emitting device) side (d4>d5). Thus, an electric field in regions (openings) of the grid 15 near the spacer 16 is distorted (equipotential line is indicated by broken lines).

A state of an electron beam orbit at this time will be described.

First, electrons exited from the electron sources travel to the openings upward in the perpendicular direction.

Next, in the vicinities of the entrance ports of the openings, the electrons are flown so as to be apart from the spacer by an electric field distribution produced according to a difference of thicknesses (D3>D4 as described above) of the grid 15. Further, in the vicinities of the exit ports of the openings, the electrons are flown so as to be apart from the spacer by an electric field distribution produced according to a difference of thicknesses (D1<D2 as described above) of the grid 15.

After that, up to the face plate, the electrons follow a course which approaches the spacer by the influence of the charged spacer. As a result, the electrons reach desirable positions.

According to this embodiment, a partial change in thickness of the grid 15 can be minimized. Accordingly, an increase of a spatial electric field strength due to an increase of a difference in partial thickness (variation) of the grid is suppressed, so that there is a merit that a large margin to discharge can be obtained.

In this embodiment, as in Embodiment 1, a light emission spot array including light emission spots resulting from the emitted electrons from the cold cathode devices 107 located in positions near the spacers is two-dimensionally produced at regular intervals. Accordingly, a color image which is sharp and has preferable color reproducibility can be displayed.

(Embodiment 4)

Figure 6:
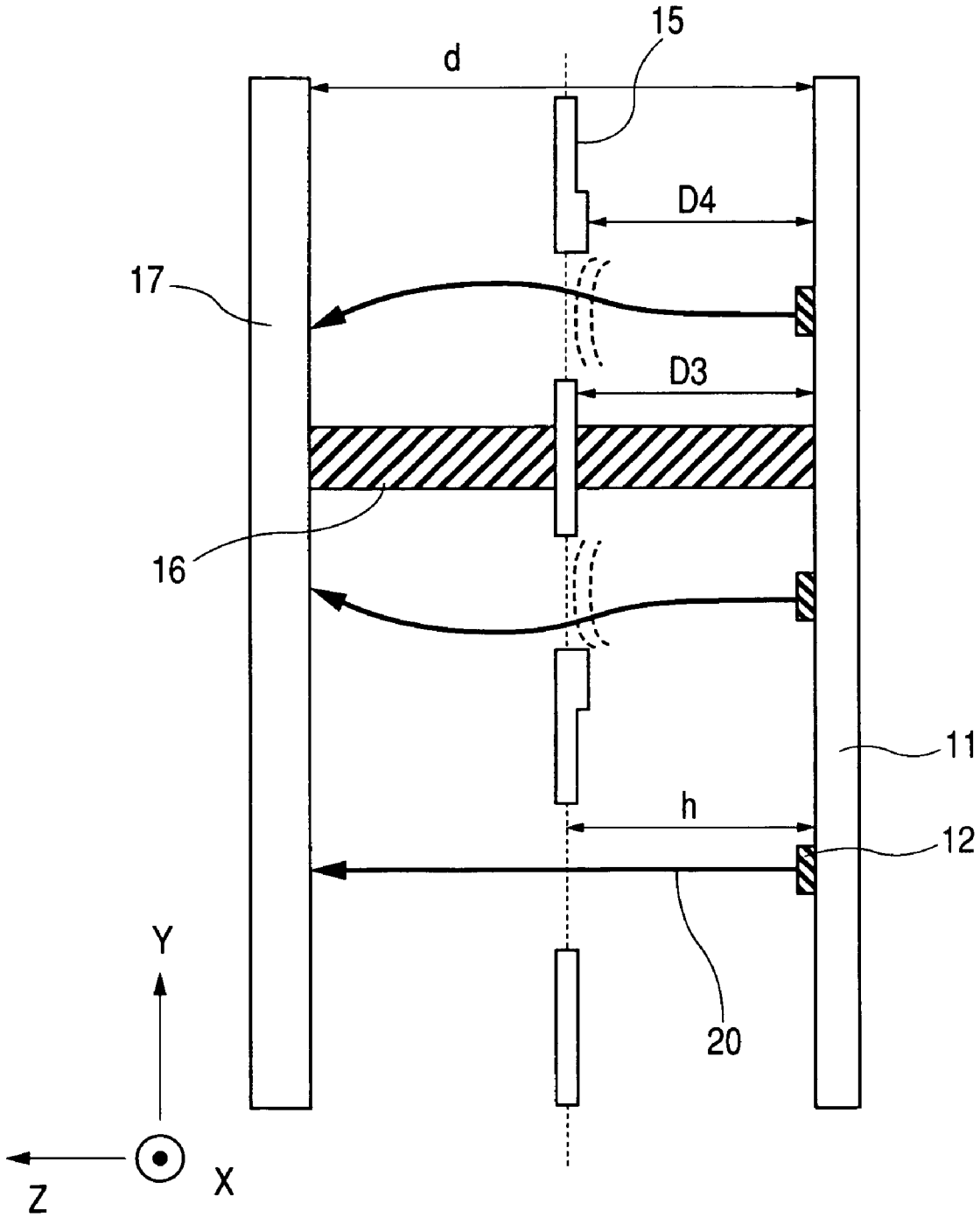
FIG. 6 is a sectional view showing Embodiment 4 of an electron beam apparatus according to the present invention.

FIG. 6 is a sectional view of an image display device according to this embodiment. A sectional structure is identical to that in Embodiment 2. A point different from Embodiment 2 is that the grid 15 is specified by a potential value different from that in Embodiment 2 (value different from a value substantially equal to a spatial potential determined by a distance between the face plate and the rear plate) using an external power source which is not shown. The grid can be formed by a method similar to that in Embodiment 1.

Specifically, Vg is set to a value larger than Va×h/d and an electric field is distorted by an action of a so-called electric lens (equipotential line is indicated by broken lines in FIG. 6).

More specifically, as shown in FIG. 6, (1) a region of the grid 15 which is located in the far side to the spacer in each of the openings nearest to the spacer is thickened so as to protrude to the rear plate side by 0.05 mm, and (2) in the case of D=1.6 mm, h=0.8 mm, and Va=10 kV, Vg is set to 6 kV, so that an electric field in regions (openings) of the grid 15 near the spacer 16 is distorted.

A state of an electron beam orbit at this time will be described.

First, electrons exited from the electron sources travel to the openings upward in the perpendicular direction.

Next, in the vicinities of the entrance ports of the openings, the electrons are flown so as to be apart from the spacer by an electric field distribution produced according to a difference of thicknesses of the grid 15 and an action of the electric lens. After that, up to the face plate, the electrons follow a course which approaches the spacer by the influence of the charged spacer. As a result, the electrons reach desirable positions.

According to this embodiment, a maximum thickness of the grid 15 can be minimized, so that a spatial electric field can be minimized. Thus, there is a merit that a large margin to discharge due to an increase of the electric field can be obtained.

In this embodiment, as in Embodiment 1, a light emission spot array including light emission spots resulting from the emitted electrons from the cold cathode devices 107 located in positions near the spacers is two-dimensionally produced at regular intervals. Accordingly, a color image which is sharp and has preferable color reproducibility can be displayed.

(Embodiment 5)

Figure 7:
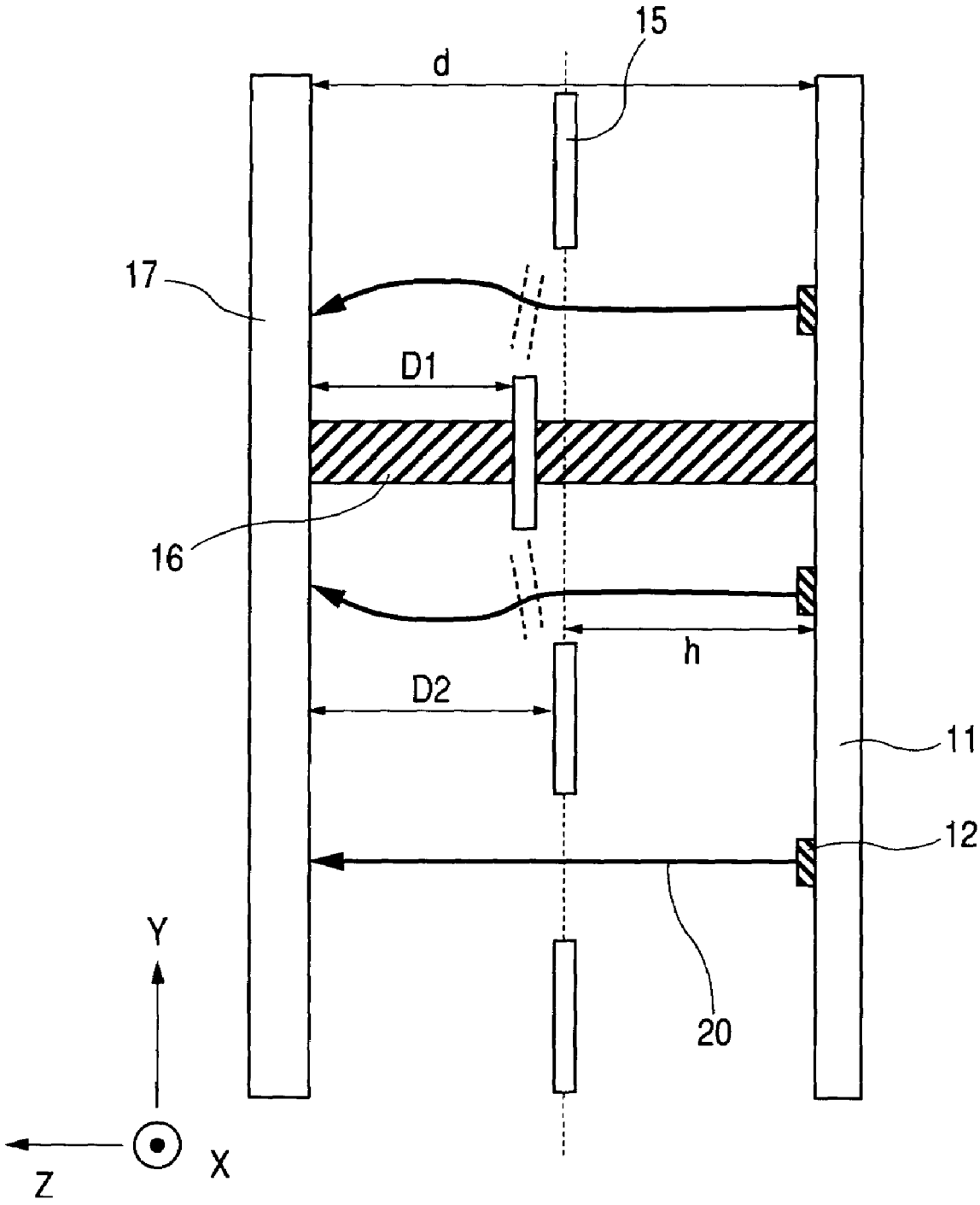
FIG. 7 is a sectional view showing Embodiment 5 of an electron beam apparatus according to the present invention.

FIG. 7 is a sectional view of an image display device according to this embodiment (equipotential line is indicated by broken lines). A grid structure is different from Embodiment 1. However, an image display device can be manufactured by a method similar to that in Embodiment 1.

Specifically, although the structure in which the thickness of the grid is changed is used in Embodiment 1, the thickness of the grid is not changed in this embodiment. That is, the shape of the grid is changed so that the regions of the grid between the openings near the spacer and spacer contact regions protrude to the face plate side. In more detail, the regions of the grid are wound (warped) to obtain a structure in which the regions protrude to the face plate side, thereby controlling an electric field.

More specifically, the region of the grid having a thickness of 0.1 mm, which is near each of the spacer contact regions is wound so as to protrude to the face plate side further than other regions, so that the grid is formed in a shape in which the regions protrude to the face plate side by 0.1 mm.

Regions other than the protruding regions of the grid are formed as in Embodiment 1 by slit-processing a single plate for grid, and the protruding regions are formed by press processing.

In the above-mentioned structure, the same effect as in Embodiment 1 can be obtained.

In this embodiment, processing of the grid 15 in the thickness direction thereof is unnecessary, so that a cost can be reduced.

Also, the protruding grid structure in this embodiment can be applied to the region whose thickness is changed in Embodiments 2 to 4 by replacing. In such a case, the same effect as in Embodiments 2 to 4 can be obtained. In addition, the protruding structure in this embodiment can be embodied by being combined with Embodiments 1 to 4. In this case, the same effect as in Embodiments 1 to 4 can be obtained, and further there is a merit in which both the thickness and the amount of winding (warping) can be reduced, thereby becoming easy to process.

(Embodiment 6)

This embodiment is identical to Embodiment 1 except that each of the spacers is a cylindrical spacer. An image display device can be formed by a method similar to that in Embodiment 1.

Figure 8:
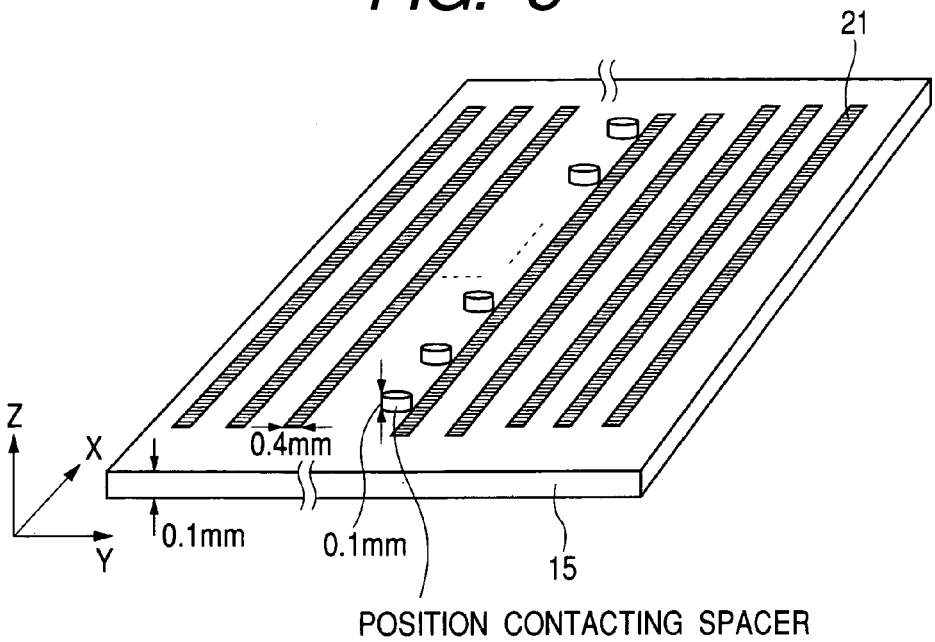
FIG. 8 shows an example of a grid according to Embodiment 6 of the present invention.

FIG. 8 shows a grid structure of the image display device according to this embodiment. The X-Y section is identical to that of FIG. 1 in Embodiment 1. Cylindrical glass having Φ of 0.2 mm is used for the spacer. As shown in FIG. 8, in this embodiment, a thickness region of each of grid contract regions becomes a cylindrical shape in correspondence with the cylindrical spacer.

According to this embodiment, as in Embodiment 1, the disturbance of an electronic orbit due to charge is corrected by an electric field near the openings, so that beams can be produced at desirable positions.

Also, the cylindrical spacers in this embodiment can be applied corresponding to those in Embodiments 2 to 5 and the same effect as in Embodiments 2 to 5 can be obtained.

Further, in the above-mentioned Embodiments 1 to 6, the example in which the grid has the slit openings is described.

Individual openings corresponding to the respective electron-emitting devices may be used.

Up to now, the present invention is described in detail with reference to the Embodiments. The essence of the present invention is to "correct the deviation of the electron beams resulting from the spacers by using the grid opening structure according to the positional relationship with the spacers (and by suitably specifying the grid potential).

Therefore, in these embodiments, various parameters are determined based on a measurement of the charge amount of the spacer, an electric field simulation, and a measurement of beam positions.

Accordingly, it is needless to say that the above-mentioned grid opening structures and the specific voltages are merely examples and are changed as appropriate according to the structure of the display device.

For example, in the case of the structure in which the surface of the spacer is negatively charged in Embodiment 1, the correction direction in the grid openings becomes reverse. Therefore, it is necessary to thicken the spacer location region to the rear plate side. Also, in order to reduce the amount of charge, a resistor film is formed on the surface of each of the spacer and connected between the anode (metal back) and the grid and between the electron source and the grid. Then, an extremely weak current is made to flow into the resistor film. Thus, a structure in which the amount of charge on the surface of the spacer is reduced can be used. In this case, a thickness of a region around the opening of the grid and a protruding size may be changed as appropriate.

As described above, according to the present invention, the deviation of the orbit of the electron beam emitted from the electron-emitting device is suppressed, so that a high quality image can be produced.

What is claimed is:

1. An electron beam apparatus, comprising:

an electron source including an electron-emitting device;

an electron beam irradiation member which is opposed to the electron source and irradiated with an electron emitted from the electron-emitting device;

a potential specifying plate which is located between the electron source and the electron beam irradiation member and which includes a plurality of openings through which the electron emitted from the electron-emitting device transmits; and a spacer located between the electron beam irradiation member and the potential specifying plate, wherein D1 defined as a distance between a portion of the potential specifying plate between one opening, of the plurality of openings of the potential specifying plate, near the spacer and the spacer and the electron beam irradiation member, and D2 defined as a distance between a portion of the potential specifying plate between the one opening of the potential specifying plate near the spacer and another opening of the plurality of openings of the potential specifying plate not near the spacer and the electron beam irradiation member, meet a relationship D1<D2.

2. An electron beam apparatus, comprising:

an electron source including an electron-emitting device;

an electron beam irradiation member which is opposed to the electron source and irradiated with an electron emitted from the electron-emitting device;

a potential specifying plate which is located between the electron source and the electron beam irradiation member and which includes a plurality of openings through which the electron emitted from the electron-emitting device transmits; and a spacer located between the electron source and the potential specifying plate, wherein D3 defined as a distance between a portion of the potential specifying plate between one opening, of the plurality of openings of the potential specifying plate, near the spacer and the spacer and the electron-emitting devices, and D4 defined as a distance between a portion of the potential specifying plate between the one opening of the potential specifying plate near the spacer and another opening of the plurality of openings of the potential specifying plate not near the spacer and the electron-emitting device, meet a relationship D3<D4.

3. An electron beam apparatus according to claim 1, wherein a thickness of the portion of the potential specifying plate between the one opening of the potential specifying plate near the spacer and the spacer is larger than a thickness of the portion of the potential specifying plate between the one opening of the potential specifying plate near the spacer and another opening of the plurality of openings of the potential specifying plate, not near the spacer.

4. An electron beam apparatus according to claim 2, wherein a thickness of the portion of the potential specifying plate near the spacer and the another opening of the potential specifying plate not near the spacer is larger than a thickness of the portion of the potential specifying plate between the one opening of the plurality of openings of the potential specifying plate near the spacer and the spacer.

5. An electron beam apparatus according to claim 1, wherein the potential specifying plate has, between the one opening near the spacer and the spacer, a protrusion protruding toward a side of the electron beam irradiation member.

6. An electron beam apparatus according to claim 2, wherein the potential specifying plate has, between the opening near the spacer and the another opening not near the spacer, a protrusion protruding toward a side of the electron beam irradiation member.

* * * * *

UNITED STATES PATENT AND TRADEMARK OFFICE

CERTIFICATE OF CORRECTION

PATENT NO. : 7,075,223 B2
APPLICATION NO. : 10/684374
DATED : July 11, 2006
INVENTOR(S) : Yoichi Ando It is certified that error appears in the above-identified patent and that said Letters Patent is hereby corrected as shown below:

ON TITLE PAGE ITEM (56) U.S. PATENT DOCUMENTS

"6,828,722 B1 * 12/2004 Ueda et al. …. 313/495" should read --6,828,722 B2 * 12/2004 Ueda et al. …. 313/495--.

COLUMN 4

Line 57, "portion," should read --portions,--.

COLUMN 7

Line 1, "pattering" should read --patterning--.

COLUMN 9

Line 11, "is" should read --are--.

COLUMN 10

Line 56, "becomes-larger" should read --becomes larger--.

Signed and Sealed this

Sixth Day of March, 2007

JON W. DUDAS
*Director of the United States Patent and Trademark Office*